US006056494A

United States Patent [19]

Fong et al.

[11] Patent Number: 6,056,494

[45] Date of Patent: May 2, 2000

[54] PHOTO ALBUM PAGE AND FABRICATION APPARATUS AND METHOD

[76] Inventors: Kiew Ah Fong; Whang Kwee Tan, both of 17A Ah Soo Garden, Singapore, Singapore, 537926

[21] Appl. No.: 09/350,612

[22] Filed: Jul. 9, 1999

Related U.S. Application Data

[63] Continuation-in-part of application No. 09/234,222, Jan. 20, 1999, Pat. No. 5,997,041.

[51] Int. Cl.[7] ..... B42C 9/00

[52] U.S. Cl. ..... 412/37; 412/8; 281/38; 402/79

[58] Field of Search ..... 402/79, 80 R, 402/4; 281/22, 38, 40, 51; 412/1, 8, 37, 900, 901, 902

[56] References Cited

U.S. PATENT DOCUMENTS

| | | | |
|---|---|---|---|
| 4,824,273 | 4/1989 | Silva et al. | 402/74 |
| 4,965,948 | 10/1990 | Ruebens | 402/74 |
| 5,250,318 | 10/1993 | Tooker | 412/8 X |
| 5,316,404 | 5/1994 | Hensel | 402/79 |
| 5,403,138 | 4/1995 | Otake et al. | 412/8 X |

*Primary Examiner*—Willmon Fridie, Jr.

[57] ABSTRACT

Disclosed are photo album pages made by adhering two sheets of transparent plastic to a piece of paper with adhesive material to all attachment lines running horizontally. A plurality of compartments are created for the storage of photographs. The newly designed photo album pages provide a space for memo writing and allow consumers to insert photographs from the side farthest from the spine and use the memo writing paper to act as a stopper. This orientation provides convenience to consumers and saves material for the manufacturer. Also included is the method and apparatus for fabricating such pages.

17 Claims, 6 Drawing Sheets

16
18
20
22
24
26
28
30
32
34
36
38
40
44
48
52
56
58
60
62
64
66
68
72
74
76
78
80
82
84
86
88
90
92
94
96
D 100
102
104
106
108
110
112
114
116
118
120
122
124
126
130
132
D 166
192
188
182
180
196
172
170
174
176
178
168
D
D

PHOTO ALBUM PAGE AND FABRICATION APPARATUS AND METHOD

RELATED INVENTION

This application is a continuation-in-part of U.S. Application Ser. No. 09/234,222 filed Jan. 20, 1999, now U.S. Pat. No. 5,997,041.

BACKGROUND OF THE INVENTION

1. Field of the Invention

The present invention relates to a new and improved photo album page and a fabrication apparatus and method therefor and, more particularly, pertains to fabricating photo album pages with space provided for memo writing and insertion of photographs from the side farthest from the spine of the photo album in which they are to be supported.

2. Description of the Prior Art

Devices for the storage and display of photographs have taken many forms. One of the most common forms is a photo album which utilizes a construction like a book or a loose-leaf binder, with pages of paper on which the photographs are mounted by various means, such as adhesive, transparent pockets affixed to the pages, corner mounts on the pages, or the like.

Adhesive mounting means employed in conjunction with cardboard-type pages involve coating the entire album page with an adhesive substance which retains the photographes on the album page covering with a transparent plastic sheet which will prevent the photographs from falling out and prevent adjacent album pages from adhering. Even though this method provides a good mount, there are also disadvantages to it. First of all, it fails to provide a place for memo writing; secondly, the cost of raw material and production are high; thirdly, the adhesive material will change as time passes by resulting in a high risk of damaging the photo when removing from the album page as the adhesive material may stick to the photograph strongly or the adhesive material may dry up and allow the photographs to fall out.

Another means of mounting photographs is by employing cardboard-type pages and retaining photographs by using small adhesive, triangular-shaped pockets to receive the corner edges of the photographs. These small adhesive, triangular-shaped pockets are commonly referred to as "photo corners"; usually four photo corners are needed for one photograph. This means of mounting provides a good and elegant mount, but it suffers from the disadvantage of being the highest production cost to the manufacturers. As for consumers, they do not only have to purchase the photo album at a high price, but they also have to purchase photo corners separately at a price similar to the price of the photo album, the photo album will tend to be very heavy in weight as well.

Among the various means of mounting photographs, the most common are photo album pages with transparent pockets. The transparent pockets are formed by sealing two sheets of flexible transparent material together creating compartments or by adhering two sheets of flexible transparent material to both faces of a piece of paper and creating pockets or compartments to accommodate photographs. These pages come in two major forms: 1) album pages with a memo writing area; and 2) album pages without a memo writing area.

In U.S. Pat. No. 4,702,026 to Shaine, there is disclosed a method of making pages of photo album comprising the steps of passing a first elongated continuous sheet of a flexible transparent plastic material through a work station, extruding a plurality of spaced lines of a hot-melt, pressure-sensitive adhesive onto the first sheet at the work station, overlaying a second elongated continues sheet of flexible transparent plastic material on the first sheet, pressing the two sheets together so that they are secured together with the adhesive to define a composite sheet, and transversely cutting the composite sheet at predetermined intervals to form a plurality of pages.

In U.S. Pat. No. 5,242,522 to Moir, there is disclosed a method for producing a photo album page composed of superposed panels of transparent polypropylene film joined together by parallel lines of adhesive to define channels, each of which is divided by a paper strip into front and rear compartments to accommodate photos. To make photo album pages of this type, two webs of polypropylene film are concurrently advanced into combining rolls. Applied to the inner surface of one of the polypropylene film are concurrently advance into combining rolls. Applied to the inner surface of one of the polypropylene webs are parallel lines of hot-melt adhesive whose chemistry is such that it has an affinity for polypropylene. When the webs are adhered together in the combining rolls, the lines create a plurality of channels. Also concurrently fed into the combining rolls in the spaces between the lines are a like plurality of paper tapes, whereby emerging from the rolls is a composite web which is then slit into individual album pages.

Both of the inventions mentioned above share many similarities. They both use two webs of flexible transparent material to form photo album pages. The procedures are basically the same: by extruding longitudinal parallel lines of adhesive material onto one of the transparent material and overlaying the other sheet of transparent material onto the first one and advancing into combining rolls to secure the bonding. The major difference is that the Moir invention, U.S. Pat. No. 5,242,522, concurrently feeds paper tapes into the combining rolls in the spaces between the lines of adhesive material, and uses different types of adhesive material.

There is no doubt that both inventions will produce pages for photo album as a means for the storage of photographs. What is not achieved in these methods of producing photo album pages, however, is the creation of a memo writing area for consumers to utilize in writing down the events and happenings, or personal comments, relative to each photo. This feature is highly desirable for consumers in today's photo album market.

Photo albums without a memo writing area are less popular and are rapidly being replaced by photo albums with memo writing areas. Basically there are two types of memo photo pages for photo albums on the market. The first type has the memo writing area located longitudinally along the side nearest to the spine. The second type has a narrow loose strip of paper inserted horizontally in a compartment between the pockets.

The disadvantage of memo pages with memo writing areas along the side nearest the spine concerns the manufacturing process. The manufacturer must use more material than is really needed in order to avoid the side immediate to the spine becoming too bulky, and the photo album becoming too thick. In order to provide a better and smoother insertion of the photographs for the consumers, an unnecessary wider space of memo writing area is required and, as a result, increases the material cost. Even with the much wider space of memo writing area, these pages still create difficulties in writing and inserting the photographs, and in many cases, the flexible transparent plastic material will eventually tear from the page.

The disadvantage of the horizontal memo writing area is that the photo album will contain very awkward proportions. The photo album will end up being long and too tall for the bookshelves of most consumers. Also, such size increases the storage and transportation costs for both manufacturers and retailers. Consumers will have to pull and insert the stripes of paper every time when writing a memo, which is greatly inconvenient. In cases when the paper strips are not thick enough, it will be extremely difficult to insert the paper strips back into the tight compartments or pockets.

In this respect, the photo album page according to the present invention substantially departs from the conventional concepts and designs of the prior art, and in doing so provides photo album pages with space provided for memo writing and insertion of photographs from the side farthest from the spine of the photo album.

Therefore, it can be appreciated that there exists a continuing need for a new and improved photo album page with space provided for memo writing and as a stopper to prevent photographs from falling out, plus allow the insertion of photographs from the side farthest from the spine of the photo album. In this regard, the present invention substantially fulfills this need.

SUMMARY OF THE INVENTION

In view of the foregoing, the principle object of the invention, therefore, is to provide a new and improved photo album pages with the advantages of being able to save material, storage and transportation costs, and of being able to provide the greatest convenience for the consumer.

In summary, the present invention provides pages for photo albums which have substantial advantages over the above-mentioned different types of pages as a means for the storage of photographs. Particularly, this type of photo album page will help manufacturers to save substantial costs in raw material and will provide the greatest convenience for the consumer. The page provides a memo writing area and an opening for insertion of the photographs strategically located on the farthest side from the spine of the photo album. this location is arrived at after recognizing the fact that providing a memo writing area and insertion immediate to the spine of the photo album makes writing and insertion extremely difficult. Inserting photographs from the farthest side from the spine of the photo album will provide the smoothest insertion.

The method of producing the page is by making use of webs of flexible transparent plastic material, webs of printed paper or plain paper and webs of narrow thick memo writing paper. With the same fabrication system, there are three types of photo album page may be produced simply by using different combination of webs of material in the operation.

The first type, Type A is by making use of two webs of flexible transparent plastic, two webs of printed paper and four webs of narrow thick paper. Where the width of the flexible transparent plastic is greater than the width of the printed paper, and the width of the printed paper is greater than the narrow thick memo paper. The two webs of printed paper are to lay side by side leaving a gap in between and the two webs of flexible transparent material are to overlay and adhere to both sides of the printed papers with T-shaped horizontal lines of adhesive material applied concurrently across the paper in predetermined distances by a pair of rollers in the work station. The sheets of flexible transparent plastic do not cover the two borders of the sheets of paper as a whole for the purpose of adhering the four webs of narrow thick paper longitudinally on both sides of these two borders use as memo writing area and as stopper to prevent photographs from falling out. All the webs of material eventually advance to the combining rollers to secure the bonding and will be cut into individual pages in the last stage of the work station.

The second type of album page, Type B is by making use of one web of printed paper, four webs of flexible transparent plastic material and four webs of narrow thick paper. The width of the printed paper is greater than the combined width of two flexible transparent plastic material and two narrow thick paper. With predetermined T-shaped horizontal lines of adhesive material applied in the printed paper, the four webs of flexible transparent plastic material are to adhere to both sides of the printed paper with two webs on each side and leaving a portion in the middle and the side borders longitudinally uncovered. At the same time, the four webs of narrow thick paper are to adhere to the side borders longitudinally with two on each side of the paper which will be used as the memo writing area and as a stopper to prevent photographs from falling out. Exactly like the steps involved mentioned in the first type of photo album page, the webs of material eventually advance to the combining rollers to secure the bonding and will be cut into individual pages during the last stage of the work station.

The third type of photo album page, Type C is by making use of one web of printed paper, four webs of flexible transparent plastic material and two webs of narrow thick memo paper. The layout of the webs of material in this type of album page is a little different from the previous two types. The four webs of flexible transparent plastic material are adhered to both sides of the printed paper with the center and the two longitudinal borders uncover. Similarly to the above mentioned album page type, there are predetermined horizontal lines of adhesive material concurrently applied on the printed paper to bond the printed paper and the flexible transparent plastic sheets together. The narrow thick memo paper will adhere to the center portion of the printed paper which will be used as the memo writing area as well as a stopper to prevent the photographs from falling out, and the two longitudinal borders will be folded into equal halves and to adhere them together by going through the folding devices in the system. The purpose of folding and adhering the borders is to create a thicker edge which will give the photo album a richer look similar to that of the expensive "book bound" album. The composite sheet will be cut into two halves in the center longitudinally then horizontally at predetermined distances to become individual pages.

The fourth type of album page, Type D is basically a combination of Type B and Type C. Type D album page is by making use of one web of printed paper, four webs of flexible transparent plastic material and six webs of narrow thick memo paper. The four webs of flexible transparent plastic material are adhered to both sides of the printed paper with the center and the two longitudinal borders uncover. Similarly to the above mentioned album page type, there are predetermined horizontal lines of adhesive material concurrently applied on the printed paper to bond the printed paper and the flexible transparent plastic sheets together. The narrow thick memo paper will adhere to the center portion and the two longitudinal borders of the printed paper which will be used as the memo writing area as well as a stopper to prevent the photographs from falling out and to create a thicker edge which will give the photo album a richer look similar to that of the expensive "book bound" album. The composite sheet will be slit into two halves in the center longitudinally then horizontally cut at predetermined distances to become individual pages.

The T-shaped horizontal lines of adhesive material are used to create a plurality of compartments when the printed paper and the transparent plastic material are adhered together in the combining roller and at the same time act as a block preventing the photographs from sliding out of the compartments. The T-shaped horizontal lines of adhesive material applied across the paper do not go from end to end to leave the two borders free from horizontal lines of adhesive, instead there will be lines of vertical adhesive applied in the two border regions to adhere the narrow thick memo paper to the printed paper for the first and second type album page, as for the third type of album page, the vertical lines of adhesive will be applied in the middle of the printed paper to adhere the narrow thick memo paper. The narrow thick memo paper will serve a few functions, one is to provide the memo writing area, and the second function is to act as a stopper to prevent the photographs from falling out and the third is to give the photo album an elegant finishing out look.

Locating the memo writing area farthest from the spine is more advantageous than locating immediate to the spine, besides providing a smoother insertion of photographs and as a stopper to prevent photographs from falling out, manufacturers are able to save more money on raw material by using smaller grams of paper instead of thicker paper which costs more to produce album page because using thinner paper has achieved a better result than thicker paper, as by adhering a strip of thicker memo paper to a thinner printed paper enabling the whole album page to stay flat and even when filled with photographs as compared to other types of album pages will be uneven when filled with photographs.

The above four types of photo album pages mentioned above have a few unique characteristics. The first unique characteristic is that the album pages are made by adhering flexible transparent plastic material to printed paper with adhesive material, secondly, the memo writing area is located in the farthest edge from the spine and thirdly, photographs are inserted from the side that is farthest from the spine and fourthly, they all use the memo writing area as a stopper to preclude the possibilities of falling out of photographs.

All four types of photo album pages are able to produce by the same fabrication system, the various mechanisms in the system will function only to the specific types of album page that is specified to produce, when some of the mechanisms are not needed, they will be shut off, for example, the folding mechanisms are turned off when producing the first and second type of album pages, they are only turned on when producing the third type of album page. When producing different size photo album pages, operators only have to change different size rollers and gears to accommodate different sizes of album pages.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. I is important, therefore, that the claims be regarded as including such equivalent constructions insofar as they do not depart from the spirit and scope of the present invention.

Further, the purpose of the foregoing abstract is to enable the U.S. Patent and Trademark office and the public generally, and especially the scientists, engineers and practitioners in the art who are not familiar with patent of legal terms or phraseology, to determine quickly form a cursory inspection the nature and essence of the technical disclosure of the application. The abstract is neither intended to define the invention of the application. The abstract is neither intended to define the invention of the application, which is measured by the claims, nor is it intended to be limiting as to the scope of the invention in any way.

It is therefore an object of the present invention to provide a new and improved photo album page which has all the advantages of the prior photo album page and none of the disadvantages.

It is another object of the present invention to provide a new and improved photo album page fabrication system to produce a photo album page which may be easily and efficiently manufactured and marketed.

It is a further object of the present invention to provide a new and improved photo album page which is of a durable and reliable construction.

An even further object of the present invention is to provide a new and improved photo album page which is susceptible of a low cost of manufacture with regard to both materials and labor and which accordingly is then susceptible of low prices of sale to the consuming public, thereby making such photo album pages economically available to the buying public.

Still yet another object of the present invention is to provide a new and improved photo album page fabrication system which provides in the apparatuses and methods of the prior art some of the advantages thereof while simultaneously overcoming some of the disadvantages normally associated therewith.

Even still another object of the present invention is to fabricate photo album pages with space provided for memo writing and insertion of photographs from the side farthest from the spine of the photo album.

Lastly, it is an object of the present invention to provide a photo album page made by adhering two sheets of transparent plastic to a piece of paper with adhesive material to all attachment lines running horizontally. A plurality of compartments are created for the storage of photographs. The newly designed photo album page provides a space for memo writing, a stopper to prevent photographs from falling out and allows consumers to insert photographs from the side farthest form the spine. This orientation provides convenience to consumers and saves material for the manufacturer. Also included is the method and apparatus for fabricating such page.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive mater in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
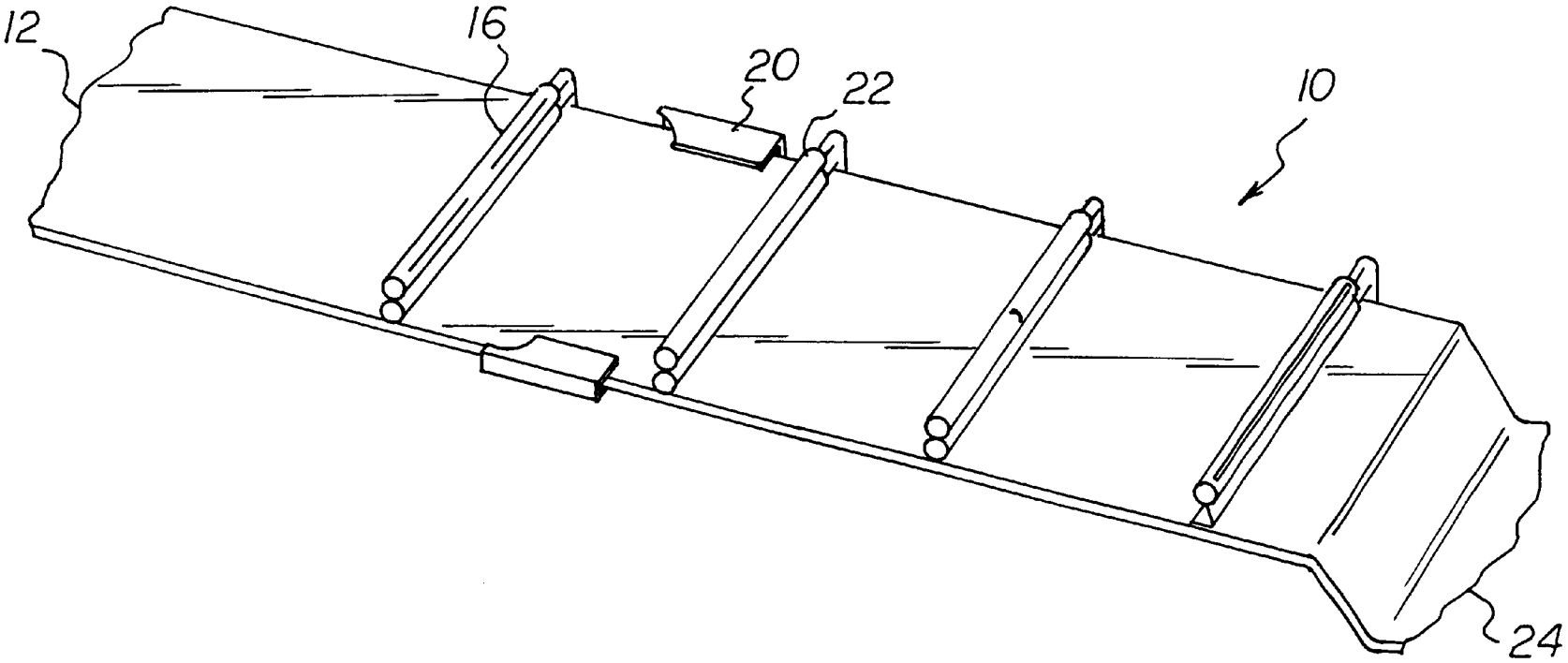
FIG. 1 is a perspective illustration of the new and improved photo album page fabrication system constructed in accordance with the principles of the present invention.

FIG. 1 is an illustration schematizing the method and procedures for producing the different types of album pages. The same fabrication system is able to produce the following three types of photo album pages.

Provided in the system 10 as shown in FIG. 1 is a path of travel between an input end 12 and an output end 14. One pair of gluing rollers 16 is provided. The gluing rollers 16 are located above the path of travel downstream from the input rollers adapted to provide a linear extent of glue, the horizontal glue lines, centrally along the length of the borders or edges of the paper. The gluing rollers also concurrently apply longitudinal lines, the vertical glue lines, of adhesive material to the borders of the printed paper or backing sheet 18 as the rollers run. The gluing rollers are able to exchange for different sizes in order to accommodate different lines of adhesive to different types of album page. Next provided in the system is a pair of folding mechanisms 20. The folding mechanisms are only applying to Type C album pages. They are disabled during the production of Type A and Type B album pages. The folding mechanisms fold the edges of the printed paper to give the album pages a richer and thicker look. A pair of combining rollers 22 is provided next in the fabrication system. The function of the combining rollers 22 is to secure the bonding of the various sheets of material. Two sets of cutters 24 and 26 are provided to cut the composite sheet into individual pages. Cutter 24 is only applicable to Type C album pages, the cutter 24 will cut the composite sheet vertically into two equal halves. And cutter 26 will cut the composite sheet horizontally into individual pages. Cutter 26 is applicable to all types of album pages.

Figures 2, 2A, 2B, 2C, 2D:
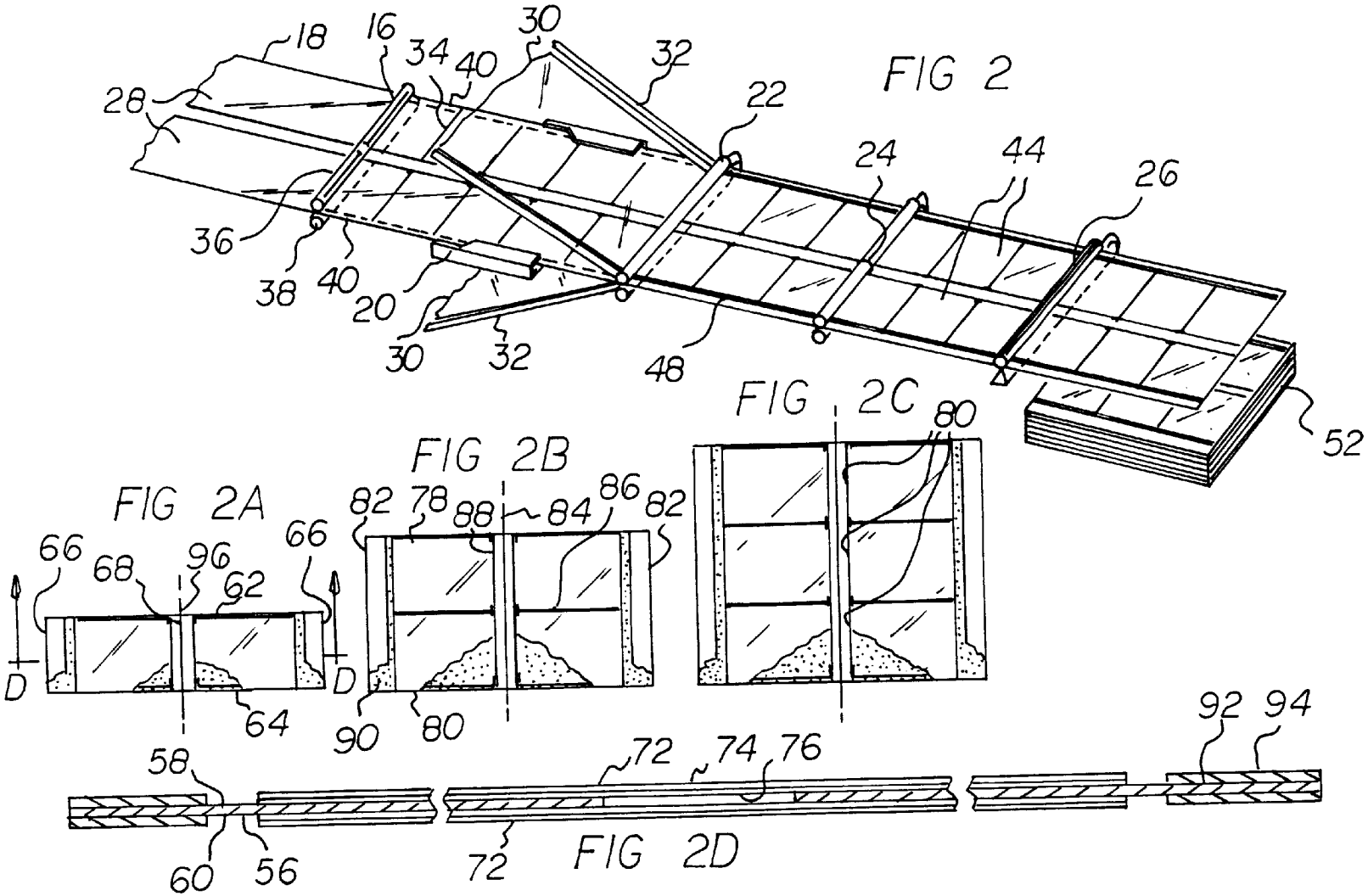
FIG. 2 is a perspective illustration of producing Type A photo album page.
FIG. 2A is a perspective view of a triple compartment Type A album page.
FIG. 2B is a perspective view of a double compartment Type A album page.
FIG. 2C is a perspective view of a single compartment Type A album page.
FIG. 2D is a cross sectional view taken along line D—D of FIG. 2A.

FIG. 2 is the first type of album page which is comprised of two rolls of printed paper 28, two rolls of flexible transparent plastic material 30 and four rolls of thick narrow memo writing paper 32. The two elongated sheets of printed paper 28 are to lay flat in the work station side by side with a small gap in between to be the folding line. Lines of T-shaped horizontal adhesive material 34 are applied to the printed paper 28 with a pair of rollers 36, 38. The distance between the T-shaped horizontal lines of adhesive material 34 is predetermined as the gluing rollers 36, 38 turn at a predetermined speed when applying the T-shaped horizontal adhesive lines 34 on the sheets of paper 28. The dimensions of the page and the distance between the T-shaped horizontal lines of adhesive material 34 is very much dependent on the size of the photographs to be mounted. Concurrently from the same pair of rollers 36, 38, there are two parallel continuous lines of adhesive material 40 applying to the two extreme borders of the two sheets of printed paper 28. Two sheets of flexible transparent plastic material 30 are to overlay and adhere to both sides of the two printed papers 28 leaving the two longitudinal borders uncover. The bonding of the flexible transparent plastic material 30 and the printed paper will create a plurality of compartments or pockets 44 for the storage of photographs. At the same time as show in FIG. 2, four strips of narrow thick memo writing paper 32 are to adhere to the two longitudinal borders in both sides of the printed paper 28 for the purpose of creating memo writing area. There will be a small gap in between the flexible transparent plastic material 30 and the memo writing paper 32 for the insertion of photographs. The whole composite sheet 48 will go through a pair of combining rollers 22 to secure the bonding of the different materials. Lastly, the composite sheet 48 will be cut into individual pages 52 by a rotary cutter 26 in the system.

FIG. 2A, FIG. 2B, FIG. 2C and FIG. 2D are examples of the different sizes of photo album page the fabrication could produce. To produce different sizes of photo album page in this fabrication, the operator simply change the gear of the cutter 26 so that the desired size is achieved. For example, if the desired size of the photo album page is one photo per page, then the gear of the cutter 26 will be much smaller than the gear for of album page size desired for triple photo per page and so on.

More specifically to the album page of FIGS. 2A, 2B, 2C includes a backing sheet 56 in a rectangular configuration. It has a front face 58 and a back face 60 and with parallel upper and lower edges 62, 64 and parallel vertical side edges 66,68 there between including a free outboard edge 66 and a spine-couplable inboard edge 68. The inboard edge is adapted to be formed for coupling to a photo album spine, preferably through apertures. Albums and spines readily capable of receiving the pages disclosed herein are described in co-pending application Ser. No. 09/234,222 filed Jan. 20, 1999, of which this application is a continuation-in-part, and the subject matter of which is incorporated herein by reference. The backing sheet is of a size greater than a photograph to be received and supported thereby. A pair of transparent cover sheets 70, 72 are provided. Each cover sheet is in a rectangular configuration with a front face 74, and a back face 76, and with parallel upper and lower edges 78, 80 and parallel vertical side edges 82, 84, including an outboard edge 82 and an inboard edge 84. Each cover sheet is of a size greater than a photograph to be received and supported thereby. The vertical edges are essentially the same length as the vertical edges of the backing sheet. The horizontal edges are of a length less than the horizontal edges of the backing sheet. A pair of spaced horizontal glue lines 86 couple the cover sheets to the faces of the backing sheet. The space between the horizontal glue lines is greater than the height of a photograph to be received and supported thereby. A vertical glue line 88 couples the inboard edge of each cover sheet to the backing sheet with the outboard edge of each cover sheet constituting an opening 90. Such opening is for the positioning and removal of a photo between the cover sheet and backing sheet. The distance between the vertical glue lines and the opening is less than the width of a photo to be received and supported there between. Each cover sheet is spaced from the outboard edge of the backing sheet to provide a writing strip receiving area 92 and a strip of writing material 94 adhered tin proximity to the outboard edge of each face of the backing sheet and spaced from each cover sheet to provide a writing surface for indicia corresponding to the photo supported there adjacent. Such descriptions are applicable to all of the embodiment herein.

With regard to the Type A embodiment of FIGS. 2A–2D, each page includes two cover sheets 70, 72 in a horizontally extended orientation including a centrally located vertical center line 96. Two backing sheets 56 are spaced from each other and from the vertical center line. Four strips of writing material 94 are on the front and back faces of the backing sheets adjacent to the two outboard edges spaced in close proximity from the outboard edges of the cover sheets. Vertical glue lines 88 are adjacent to the vertical center line and with the opening 90 between the backing sheets and cover sheets being adjacent to the writing strips.

Figures 3, 3A, 3B, 3C, 3D:
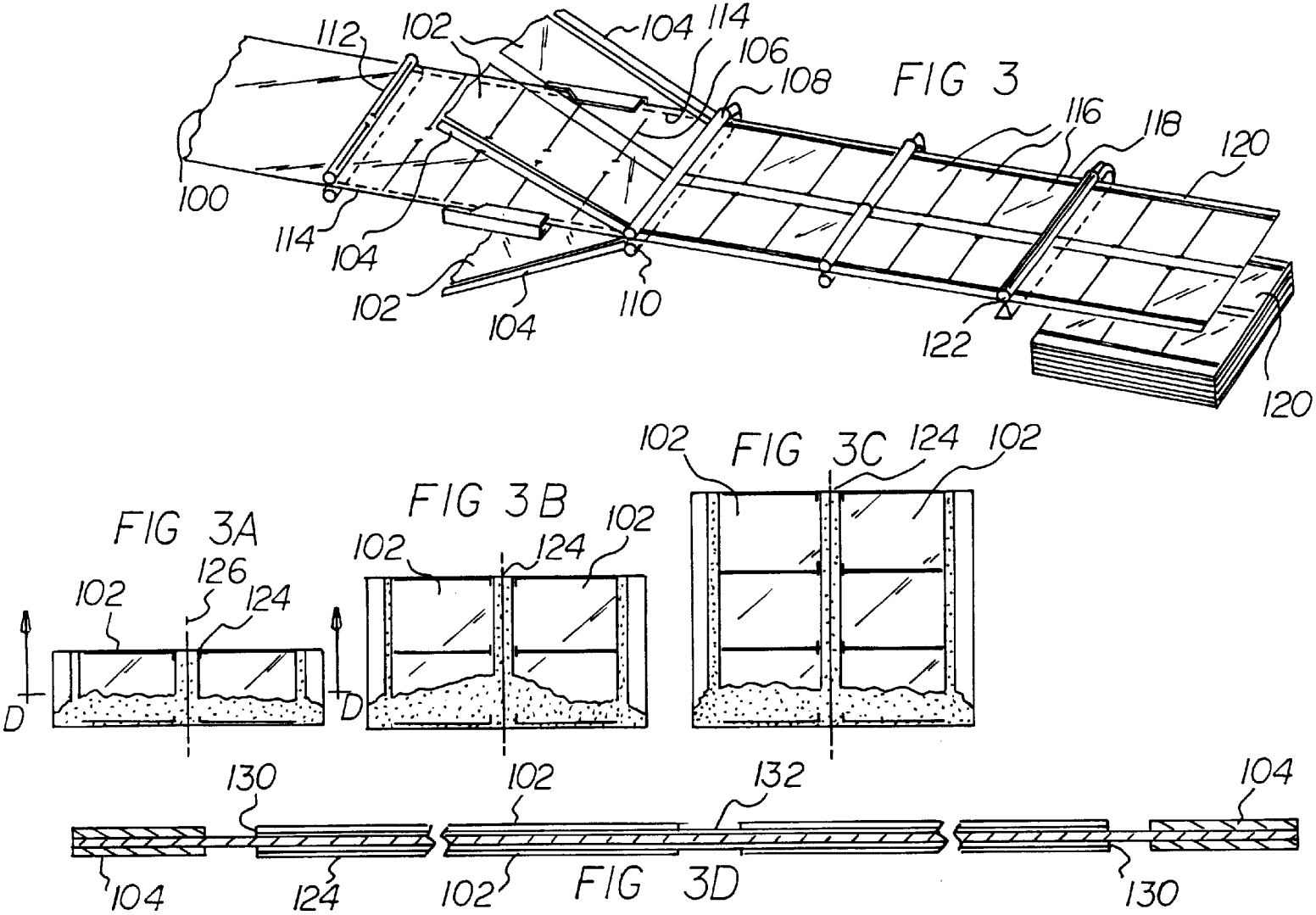
FIG. 3 is a perspective illustration of producing Type B photo album page.
FIG. 3A is a perspective view of a triple compartment Type B album page.
FIG. 3B is a perspective view of a double compartment Type B album page.
FIG. 3C is a perspective view of a single compartment Type B album page.
FIG. 3D is a cross sectional view taken along line D—D of FIG. 3A.

FIG. 3 is the second type of album page which is comprised of one roll of printed paper 100, two rolls of flexible transparent plastic material 102 on each side and four rolls of thick narrow memo writing paper 104. The elongated sheet of printed paper 100 is to lay flat in the work station and advancing according to the movement of the system. Lines of T-shaped horizontal adhesive material 106 are applied to the printed paper 100 with a pair of rollers 108, 110. The distance between the T-shaped horizontal lines of adhesive material 106 is predetermined as the gluing rollers 112 turn at a predetermined speed when applying the T-shaped horizontal adhesive lines 106 on the sheet of printed paper 100, the dimensions of the page and the distance between the T-shaped horizontal lines of adhesive 106 is very much dependent on the size of the photographs to be mounted which is applying to all types of album pages in this invention. Concurrently from the same pair of rollers 108, there are two parallel continuous lines of adhesive material 114 applying to the two extreme borders of the printed paper 100. Two sheets of flexible transparent plastic material 102 are to overlay and adhere to both sides of the printed paper 100 leaving the two longitudinal borders uncover. The bonding of the flexible transparent plastic material 102 and the printed paper will create a plurality of pockets or compartments 116 for the storage of photographs. At the same time as show in FIG. 3, four strips of narrow thick memo writing paper 104 are to adhere to the two longitudinal borders in both sides of the printed paper 100 for the purpose of creating memo writing area. There will be a small gap in between the flexible transparent plastic material 102 and the memo writing paper 104 for the purpose of creating an opening for the insertion of photographs. The whole composite sheet 118 will go through a pair of combining rollers to secure the bonding of the different layers of materials. Lastly, the composite sheet 118 will be cut into individual pages 120 by a rotary cutter 122 in the system.

FIG. 3A, FIG. 3B, FIG. 3C, and FIG. 3D are examples of the different sizes of photo album page the fabrication may produce. To produce different sizes of photo album page in this fabrication, the operator simply change the gluing rollers 112 and change the gear of the cutter 122 so that the desired size is achieved. For example, if the desired size of the photo album page is one photo per page, then the gear of the cutter 122 will be much smaller than the gear for of album page size desired for triple photo per page and so on.

More specifically, this backing sheet 124 is of an extended horizontal length with a vertical center line 126 at a central extent thereof. The cover sheets 102 extend from regions in proximity to the free edges 130 to a location 132 spaced from, but in proximity to, the vertical center line.

Figure 4:
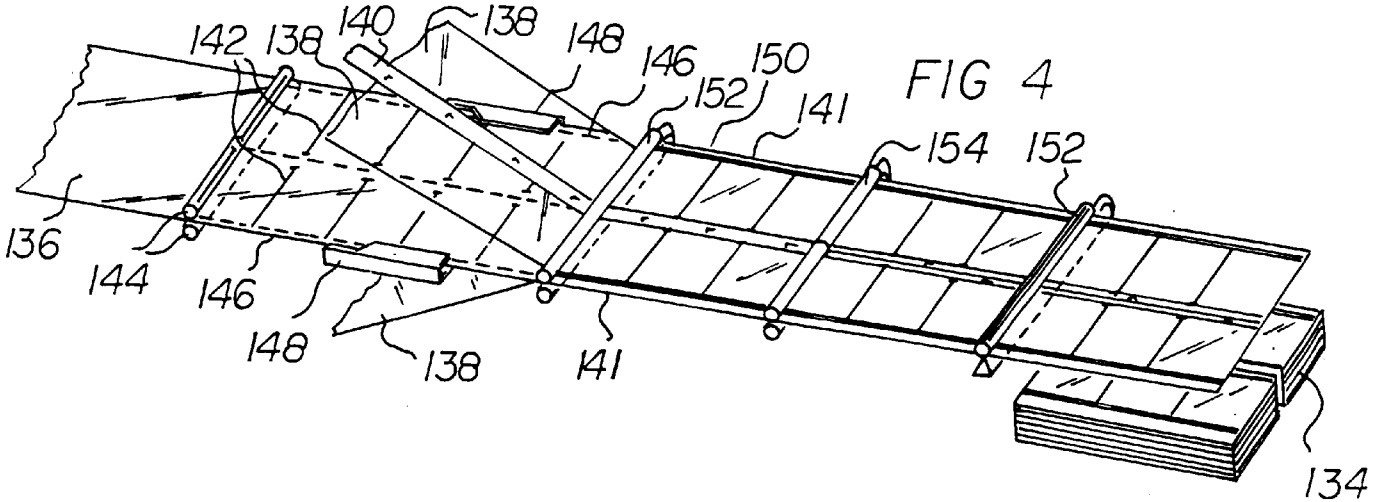
FIG. 4 is a perspective illustration of producing Type C photo album page.
Figure 4C:
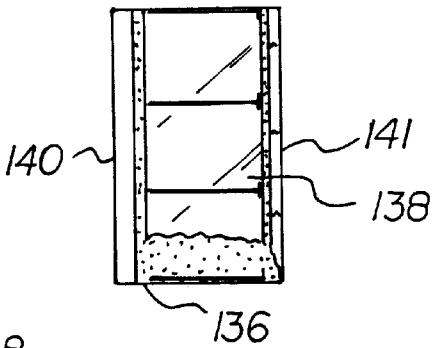
FIG. 4C is a perspective view of a single compartment Type C album page.
Figure 4B:
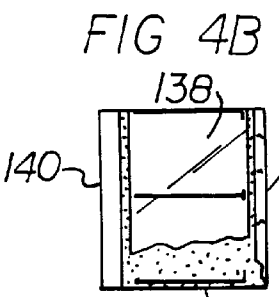
FIG. 4B is a perspective view of a double compartment Type C album page.
Figure 4A:
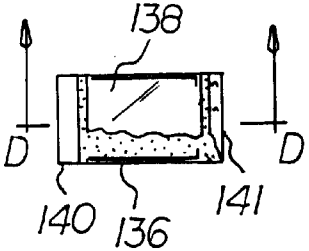
FIG. 4A is a perspective view of a triple compartment Type C album page.
Figure 4D:
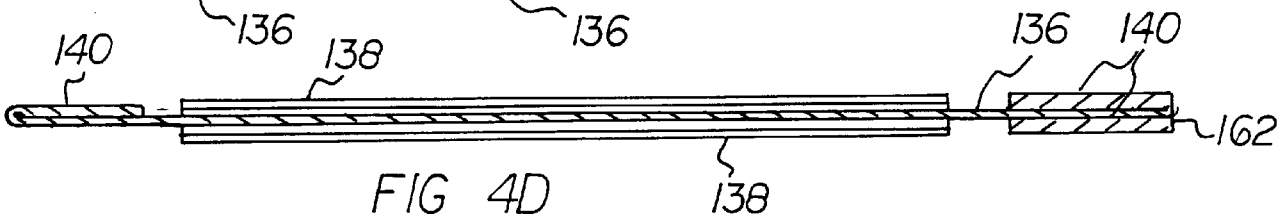
FIG. 4D is a cross sectional view taken along line D—D of FIG. 4A.

FIG. 4 is an illustration of Type C photo album page 134, most of the procedures are similar to the above two mentioned types of album page. In this type of album page 134, one roll of printed paper 136, four rolls of flexible transparent plastic material 138 and two rolls of narrow thick paper as memo writing paper 140 are needed along with folded over edges 141. As shown in the drawing, the printed paper 136 is to lay flat on the work station, horizontal lines of adhesive material 142 are applied to the printed paper 136 with a pair of gluing rollers 144, and at the same time from the same pair of rollers 144, there are longitudinal lines of adhesive material 146 applied to the two extreme borders of the printed paper and the middle of the printed paper 136. There is a pair of folding mechanisms 148 by the side of the work station, these folding mechanisms 148 only function for this type of album page 134, they will be disabled for Type A and Type B album pages. The folding mechanisms 148 are used to fold the two borders or edges 141 of the printed paper 136, so that there will be a thicker and richer edge for the album pages 134 which will look similar to that of the expensive book-bound album. Four sheets of flexible transparent plastic material 138 and two strips of thick memo writing paper 140 are to adhere to both sides of the printed paper 136. The strips of memo writing paper 140 are to adhere in between the transparent flexible transparent plastic material 138 leaving a gap of at least one millimeter for the insertion of the photographs. The whole composite sheet 150 will go through a pair of combining rollers 152 to secure the bonding of the various sheets of different material. After the combining rollers 152, there is a cutter 154 which is also specially designed for this type of album page 134, this cutter 154 will cut the composite sheet into two symmetric vertical halves from the center. After the composite sheet 150 is cut into two symmetric vertical halves, a rotary cutter 152 is provided to cut the composite sheet 150 into individual pages.

FIG. 4A, FIG. 4B, FIG. 4C and FIG. 4D are examples of the different sizes of Type C album pages. In order to process different sizes of Type C album pages, the procedures are exactly as the procedures mentioned above in Type A by changing the gluing roller 144 and the gear of the rotary cuter 152.

The Type C album pages feature writing material 141 formed from side edges being folded over adjacent to its edges. The spine edge 162 is reinforced through the strips 140.

Figures 5, 5A, 5B, 5C, 5D:
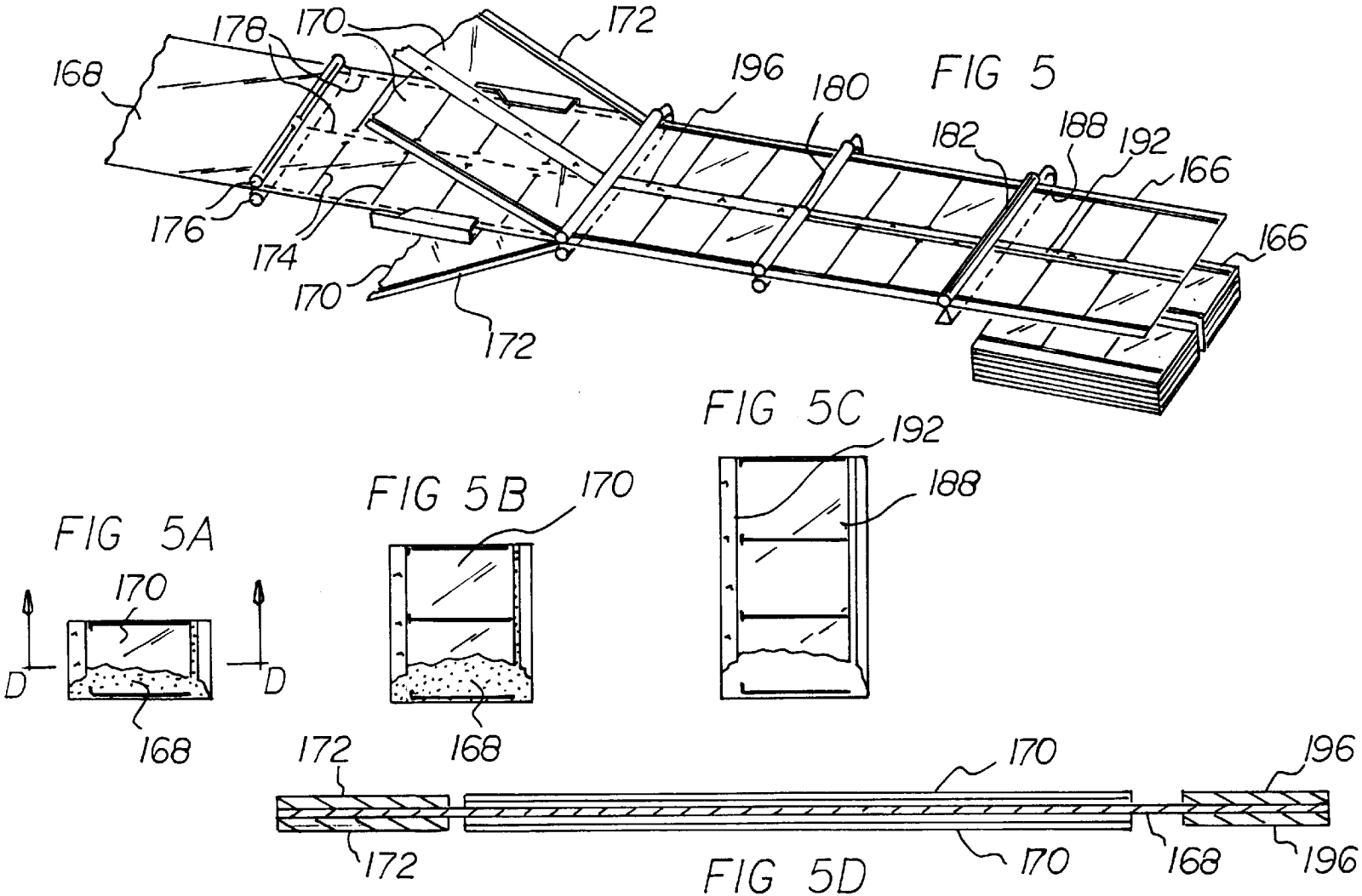
FIG. 5 is a perspective illustration producing Type D photo album page.
FIG. 5A is a perspective view of a triple compartment Type D album page.
FIG. 5B is a perspective view of a double compartment Type D album page.
FIG. 5C is a perspective view of a single compartment Type D album page.
FIG. 5D is a cross sectional view taken along line D—D of FIG. 5A.

FIG. 5 is an illustration of Type D photo album page 166, most of the procedures are similar to the above mentioned types of album page simply by combining a certain procedures of Type B and Type C album page. In this type of album page 166, one roll of printed paper 168, four rolls of flexible transparent plastic material 170 and six rolls of narrow thick paper as memo writing paper 172 are needed. As shown in the drawing, the printed paper 168 is to lay flat on the work station, horizontal lines of adhesive material 174 are applied to the printed paper 168 with a pair of gluing rollers 176, and at the same time from the same pair of rollers 176 there are longitudinal lines of adhesive material 178 applied to the two extreme borders of the printed paper and the middle of the printed paper 168. Four sheets of flexible transparent plastic material 170 and six strips of thick memo writing paper 172 are to adhere to both sides of the printed paper 168. Two strips of memo writing paper 172 are to adhere in between the transparent flexible transparent plastic material 170 leaving a gap of at least one millimeter for the insertion of the photographs and four strips of memo writing paper 172 are to adhere to both sides of the two longitudinal borders of the printed paper 168. The whole composite sheet will go through a pair of combining rollers to secure the bonding of the various sheets of different material. After the combining rollers, there is a slitter 180 which is specially designed for this type of album page 166 and Type C album page, this slitter 180 will slit the composite sheet into two symmetric vertical halves from the center. After the composite sheet is slit into two symmetric vertical halves, a rotary cutter 182 is provided to cut the composite sheet into individual pages.

FIG. 5A, FIG. 5B, FIG. 5C and FIG. 5D are examples of the different sizes of Type D album pages. In order to process different sizes of Type D album pages, the procedures are exactly as the procedures mentioned above in Type A by changing the gluing rollers 10 and the gear of the rotary cuter 14.

The album pages of Type D have the backing material 168 formed of an extended width and the cover sheets 170 extend from a region 188 adjacent to the free edges 190 of the backing sheet to a region 192 in proximity to, but spaced from, the vertical center line. The center line is covered by a reinforcing strip 196, front and back, and cut along the vertical center lien thereof for the fabrication of two similarly configured photo album pages.

Figure 6B:
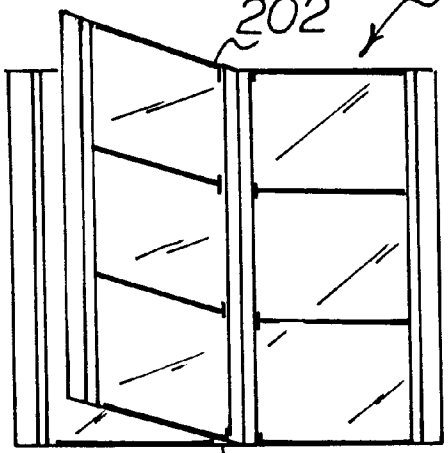
FIG. 6B is a perspective view of another sample album page produced by the same fabrication system which allowing to display both horizontal and vertical photographs.
Figure 6C:
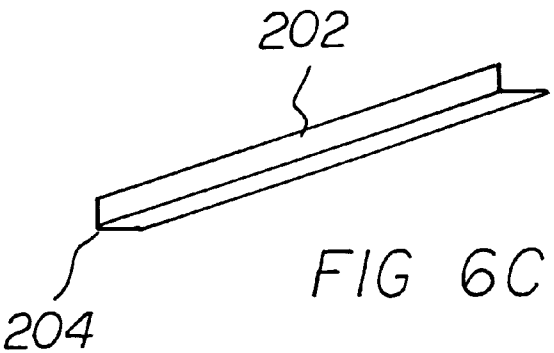
FIG. 6C is a perspective view of the connector strip of FIG. 6B.
Figure 6A:
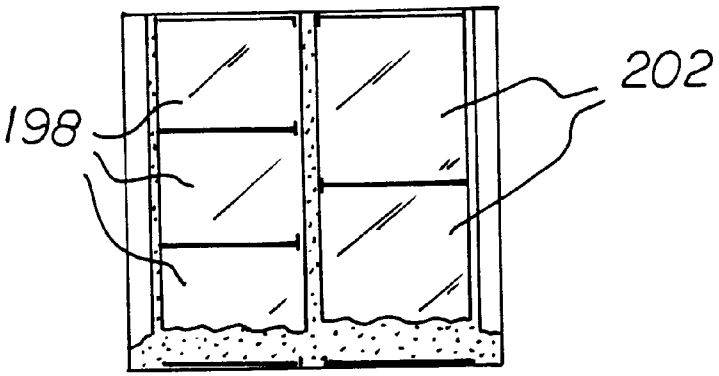
FIG. 6A is a perspective view of a sample album page produced by the same fabrication system which allowing to display both horizontal, landscape-type, and vertical, portrait-type, photographs.

FIG. 6A is an example of an album page that can be produced by the same system. As illustrated in the drawing, there are five compartments created in the album page with three pockets or compartments 198 to display photographs horizontally in a landscape-type orientation and two pockets or compartments 200 to display photographs vertically in a portrait-type orientation. As there are occasions that some of the photographs taken are vertical instead of horizontal, this type of page will definitely help consumers to organize their photographs neatly. It is not difficult to achieve this objective, the only thing the system operator has to do is to change the sizes of the gluing rollers and therefore creating different lengths and intervals of adhesive lines. In this embodiment each backing sheet supports two cover sheets on each face. One of the cover sheets has horizontal glue lines shorter than the vertical glue lines for receiving portrait style photographs and the other of the cover sheets has horizontal glue lines longer than the vertical glue lines for receiving landscape type photographs.

FIG. 6B illustrates an enhanced album page that looks more similar to the expensive book bound photo album simply by using the existing Type C album page with a strip of folded border paper 202 as illustrated in FIG. 6C. As shown in the drawing, two strips of border paper or attachment strips have central fold lines 204 and are used to adhere to three pages of Type C album page preferably using hot-melt glue, all the external sides of the folded border paper are applied with adhesive hot melt glue and adhere to the side which is immediate to the spine of the photo album of Type C album page and creating a leaflet-like album pages 206. Once the leaflet-like pages stack together and placed under heat devices, the hot melt glue will melt and therefore providing a strong bond to secure the leafletlike album pages together. The biggest advantage of this method is that it can help manufacturers save a lot of material cost by using a lighter gram of paper instead of high gram paper, because manufacturers only need to use high gram folded border paper instead of using high gram paper for the whole album page, and at the same time achieving an elegant out look similarly to that of using high gram for the whole page. Another advantage is that this method can provide a lighter photo album because of the lighter gram of paper used, this is also very important to consumers because usually photo albums will be very heavy when completely filled with photographs, and providing a lighter photo album means providing more convenience and a better product to consumers. Other than providing better convenience to consumers, by using lighter gram paper to produce photo album will help manufacturers save production cost and in turn will also be less cost to consumers.

As a decorative feature of the photo album pages, the transparent plastic material is preferably printed with indicia 210 shown as decorative designs in appropriate locations, preferably peripherally around each pocket, to enhance the overall outlook of the photo album. Note FIG. 6A. This feature will be very unique to the photo album industry because presently photo albums only have printed designs or patterns on paper, but not on the transparent plastic material. Usually when photographs are inserted into the photo album, the printed patterns on paper will be blocked by the photographs and the edges of the photographs can be seen very obviously, which makes the whole album appear not so neat. If the transparent plastic material is printed with patterns in appropriate places, then the photo album's appearance, before and after insertion of photographs, will be enhanced. Such indicia may be added to the pages of any of the embodiments disclosed herein.

The present invention may also be considered as including the apparatus or system for fabricating the photo album pages as describe above. Such apparatus or system includes a plurality of pairs of rollers including an input pair and an output pair. Defined between the pairs of rollers is a path of travel between an input end and an output end. Also provided is a first roll of sheet material. The first roll of sheet material is in the form of a web of an opaque backing sheet material of a first width and extending along the path of travel. A second roll of cover sheet material is provided. The second roll of cover sheet material is in the form of transparent plastic material of a fixed second width. The second roll is adapted to be fed into contact with the backing sheet material for movement along the path of travel with a laterally spaced border region of paper. A gluing roller is next provided. The gluing roller is in rotatable contact with the backing sheet material in advance of the input pair of rollers. The gluing roller has a region to apply glue to the cover sheet material transversely on spaced lines there across of a length less than the entire width of the paper to leave an unglued region in the lateral border. An input roller is provided and is adapted to provide a physical contact between the backing sheet material and the plastic for the forming of a bond there between and transverse pockets between the plastic and backing sheet material in the region between the bonds. The input roller is adapted to provide a linear extent of glue centrally along the length of the border. Folder mechanisms are provided on one side of the backing sheet material next following the glue rod to cause the border region of the backing sheet material to be folded inwardly when moved there past. The output rollers next follow the folder mechanisms to provide a physical contact between the folded-over region of the border. Lastly, a cutter is located next following the output rollers. The cutter is adapted to chop the sheets of backing sheet material along the central linear extent of pre-selected spaced lines of glue and into proper sized sheets for use in a photo album.

Lastly, the present invention may also be considered as including the method of fabricating the photo album page as described above as well as the method for utilizing the apparatus and system as described above. Such method includes providing a plurality of pairs of rollers including an input pair and an output pair defining there between a path of travel between an input end and an output end. The method next includes providing a first roll of backing sheet material in the form of a web of opaque paper of a fixed first width and with the paper extending along the path of travel between the input end and the output end. Next the method includes providing a second roll and a third roll of sheet material in the form of transparent plastic material of a fixed second width less than the first width of the paper. Next included is feeding the paper and plastic material together along the path of travel from the input end to the output end with equal spaced laterally spaced border regions of paper extending outwardly from the plastic material. The next method step is providing a gluing roller in rotatable contact with the paper in advance of the input pair of rollers, the gluing roller having a portion extending there across and with adhesive material within the roller. Next included is applying glue to the sheet material transversely across the central extents of both sides of the paper on spaced lines there across of a length less than the entire width of the paper to leave unglued regions in the lateral borders of the paper, the input rollers adapted to provide a physical contact between the paper and the plastic for the forming of a bond there between and transverse pockets between the plastic and paper in the regions between the bonds. Next included is applying a linear extent of glue to the paper centrally along the length of the borders of the paper. Next included is providing folder mechanisms on opposite sides of the paper next following the glue rods. Next included is folding the border regions of the paper inwardly to a location in proximity to the plastic but spaced laterally therefrom when moved there past and with the output rollers next following the folder mechanisms to provide a physical contact between the folded-over regions of the border. Next included is providing a cutter located next following the output rollers with the cutter. Finally, included is chopping the sheets of paper along the central linear extent of pre-selected spaced lines of glue and into proper sized sheets for use in a photo album.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A photo album page for removably receiving and supporting photos with an associated writing area comprising, in combination:

a backing sheet in a rectangular configuration with a front face and a back face and with parallel upper and lower edges and parallel vertical side edges there between including a free outboard edge and a spine-couplable inboard edge adapted to be formed with apertures for coupling to a photo album spine, the backing sheet being a size greater than a photograph to be received and supported thereby;

a pair of transparent cover sheets, each cover sheet being in a rectangular configuration with a front face and a back face and with parallel upper and lower edges and parallel vertical side edges including an outboard edge and an inboard edge, each cover sheet being of a size greater than a photograph to be received and supported thereby, the vertical edges being essentially the same length as the vertical edges of the backing sheet and the horizontal edges being of a length less than the horizontal edges of the backing sheet;

a pair of spaced horizontal glue lines coupling the cover sheets to the faces of the backing sheet, the space between the horizontal glue lines being greater than the height of a photograph to be received and supported thereby;

a vertical glue line coupling the inboard edge of each cover sheet to the backing sheet with the outboard edge of each cover sheet constituting an opening for the positioning and removal of a photo between the cover sheet and backing sheet, the distance between the vertical glue lines and the opening being less than the width of a photo to be received and supported there between, each cover sheet being spaced from the outboard edge of the backing sheet to provide a writing strip receiving area; and a strip of writing material adhered in proximity to the outboard edge of each face of the backing sheet and spaced from each cover sheet to provide a writing surface for indicia corresponding to the photo supported there adjacent.

2. The photo album page as set forth in claim 1 wherein each page includes two cover sheets in a horizontally extended orientation including a centrally located vertical center line and with two backing sheets spaced from each other and from the vertical center line and with four strips of writing material on the front and back faces of the backing sheets adjacent to the two outboard edges spaced in close proximity from the outboard edges of the cover sheets and with vertical glue lines adjacent to the vertical center line and with the openings between the backing sheets and cover sheets being adjacent to the writing strips.

3. The photo album page as set forth in claim 2 wherein the backing sheet is of an extended horizontal length with a vertical center line at a central extent thereof and wherein the cover sheets extend from regions in proximity to the free edges to a location spaced from, but in proximity to, the vertical center line.

4. The photo album page as set forth in claim 2 wherein writing material is formed from a writing strip folded over adjacent to its vertical center line and the spine edge is reinforced through the folding over of the backing sheet.

5. The photo album page as set forth in claim 2 wherein the backing material is formed of an extended width and the cover sheets extend from a region adjacent to the free edges of the backing sheet to a region in proximity to, but spaced from, the vertical center line and the center line is covered by a reinforcing strip, front and back, and cut along the vertical center line thereof for the fabrication of two similarly configured photo album pages.

6. The photo album page as set forth in claim 2 wherein each backing sheet supports two cover sheets on each face, one of the cover sheets having horizontal glue lines shorter than the vertical glue lines for receiving portrait style photo and the other of the cover sheets having horizontal glue lines longer than the vertical glue lines for receiving landscape type photographs.

7. The photo album page as set forth in claim 2 and further including a vertically extended attachment strip folded along a vertical center line with an adhesive secured to one face thereof for coupling together a plurality of photo album sheets in a leaflet-like orientation.

8. The photo album page as set forth in claim 2 wherein the opening is adjacent to the edge remote from the spine.

9. The photo album page as set forth in claim 2 wherein the writing material is located adjacent to the edges remote from the spine.

10. The photo album page as set forth in claim 2 wherein the writing material is located adjacent to the openings and is elevated for constituting a stopper to preclude inadvertent removal of a photo from a pocket.

11. The photo album page as set forth in claim 2 wherein the horizontal glue lines and vertical glue lines are coupled in a T-shaped configuration.

12. The photo album page as set forth in claim 2 wherein the horizontal glue lines include a horizontal glue line adjacent to the upper edges and a lower horizontal glue line adjacent to the lower edges with at least one horizontal glue line parallel and there between.

13. The photo album page as set forth in claim 2 wherein the length of the horizontal glue lines are greater than the length of the vertical glue lines for receiving photos in a landscape type orientation.

14. The photo album page as set forth in claim 2 wherein the horizontal glue lines are shorter than the vertical glue lines for receiving photos in a portrait type orientation.

15. The photo album page as set forth in claim 2 and further including indicia formed on the cover sheet peripherally over each pocket.

16. A photo album page fabrication system comprising:

a plurality of pairs of rollers including an input pair and an output pair defining there between a path of travel between an input end and an output end;

a first roll of sheet material in the form of a web of an opaque backing sheet material of a first width and extending along the path of travel;

a second roll of cover sheet material in the form of transparent plastic material of a fixed second width and adapted to be fed into contact with the backing sheet material for movement along the path of travel with a laterally spaced border region of paper;

a gluing roller in rotatable contact with the backing sheet material in advance of the input pair of rollers, the gluing roller having a region to apply glue to the cover sheet material transversely on spaced lines there across of a length less than the entire width of the paper to leave an unglued region in the lateral border, the input roller adapted to provide a physical contact between the backing sheet material and the plastic for the forming of a bond there between and transverse pockets between the plastic and backing sheet material in the region between the bonds and adapted to provide a linear extent of glue centrally along the length of the border;

folder mechanisms on one side of the backing sheet material next following the glue rod to cause the border region of the backing sheet material to be folded inwardly when moved there past and with the output rollers next following the folder mechanisms to provide a physical contact between the folded-over region of the border; and a cutter located next following the output rollers with the cutter adapted to chop the sheets of backing sheet material along the central linear extent of pre-selected spaced lines of glue and into proper sized sheets for use in a photo album.

17. A photo album page fabrication method comprising, in combination:

providing a plurality of pairs of rollers including an input pair and an output pair defining there between a path of travel between an input end and an output end;

providing a first roll of backing sheet material in the form of a web of opaque paper of a fixed first width and with the paper extending along the path of travel between the input end and the output end;

providing a second roll and a third roll of sheet material in the form of transparent plastic material of a fixed second width less than the first width of the paper;

feeding the paper and plastic material together along the path of travel from the input end to the output end with equal spaced laterally spaced border regions of paper extending outwardly from the plastic material;

providing a gluing roller in rotatable contact with the paper in advance of the input pair of rollers, the gluing roller having a portion extending there and with adhesive material within the roller;

applying glue to the sheet material transversely across the central extents of both sides of the paper on spaced lines there across of a length less than the entire width of the paper to leave unglued regions in the lateral borders of the paper, the input rollers adapted to provide a physical contact between the paper and the plastic for the forming of a bond there between and transverse pockets between the plastic and paper in the regions between the bonds;

applying a linear extent of glue to the paper centrally along the length of the borders of the paper;

providing folder mechanisms on opposite sides of the paper next following the glue rods;

folding the border regions of the paper inwardly to a location in proximity to the plastic but spaced laterally therefrom when moved there past and with the output rollers next following the folder mechanisms to provide a physical contact between the folded-over regions of the border;

providing a cutter located next following the output rollers with the cutter; and chopping the sheets of paper along the central linear extent of pre-selected spaced lines of glue and into proper sized sheets for use in a photo album.

* * * * *